United States Patent [19]

Vogel

[11] Patent Number: 4,842,556

[45] Date of Patent: Jun. 27, 1989

[54] LIGHT SWITCH CONVERTOR

[76] Inventor: Ray I. Vogel, 7720 E. 24th St. Ct., Wichita, Kans. 67226

[21] Appl. No.: 165,159

[22] Filed: Mar. 7, 1988

[51] Int. Cl.[4] ..... H01R 25/00

[52] U.S. Cl. ..... 439/638; 439/641; 439/620

[58] Field of Search ..... 439/49, 52, 53, 914, 439/924, 168, 166, 170, 174, 188, 189, 220, 518, 628, 641, 638, 703, 638, 620; 315/46, 47; 313/318, 51; 362/228, 221

[56] References Cited

U.S. PATENT DOCUMENTS

| | | | |
|---|---|---|---|
| 1,187,723 | 6/1926 | George | 439/168 |
| 2,692,373 | 10/1954 | Werner et al. | 339/31 |
| 2,788,504 | 4/1957 | Hertel | 439/628 |
| 3,054,079 | 9/1962 | Kawate | 439/168 |
| 3,165,371 | 1/1965 | Ruocco | 339/154 |
| 3,910,674 | 10/1975 | Cottone et al. | 439/628 |
| 3,936,122 | 2/1976 | Hagelberg | 439/188 |

FOREIGN PATENT DOCUMENTS

| | | | |
|---|---|---|---|
| 6413994 | 7/1965 | Netherlands | 439/220 |

OTHER PUBLICATIONS

Abstract DE 3221-656 Steimer.
RCA Technical Note-VanRenssen.

*Primary Examiner*—David Pirlot

[57] ABSTRACT

An adaptor for converting a 3-way electric light socket switch for convenient use with 1-way light bulbs provides an electrical conductor between the intermediate terminal of the switch to the central lead-in of the bulb and electrically insulates the central terminal of the socket from the components of the switch which correspond to the switch position which would normally energize the central terminal to produce a sequence of "on"-"off" conditions in the bulb from operation of the switch. A modified adaptor has conductors on each side for identical use in either orientation. A modified switch construction is also disclosed to provide optional use with either 3-way or 1-way bulbs.

10 Claims, 1 Drawing Sheet

LIGHT SWITCH CONVERTOR

This invention relates to electrical switches, and more particularly to apparatus to convert socket switches built for 3-way bulbs to convenient use with 1-way light bulbs.

3-way light bulbs are conventionally provided with two different filament circuits, each circuit having a different wattage rating than the other circuit. The socket switches of lamps which utilize such bulbs have internal operating parts whereby these circuits may be separately energized and whereby both may also be energized simultaneously.

The conventional construction is such that the energizing of the circuits upon operation of the switch follows a predetermined sequence. The first operation of the switch from the off position energizes the lowest wattage circuit to produce a relatively dim light. The next operation terminates the energy to the low wattage circuit and energizes a higher wattage circuit. This produces a brighter light. The next operation of the switch reenergizes the initial circuit without interrupting the current to the second circuit to produce a yet brighter light from the energizing of the two circuits together. The next operation of the switch returns the components to an "off" position with both filament circuits deenergized.

The selection of different available wattages with 3-way bulbs is desirable for certain installations. However, 3-way light bulbs are appreciably more expensive than 1-way bulbs which have only one filament circuit. Often the selection of three different light intensities from a lamp is not needed or wanted. The less expensive 1-way bulbs can be used in most 3-way lamp sockets. But, due to the internal construction of the switch to accommodate 3-way bulbs, it is necessary for the user to turn the switch through a plurality of switch positions to reach a switch position which produces the desired "on" or "off" condition for a 1-way bulb. This renders the switch inconvenient for use with such bulbs.

Heretofore, the lamp user who wishes to employ a 1-way bulb for economy or for other reasons, has had to either endure the inconvenience or to replace the lamp switch with one designed for 1-way bulbs. Neither of these alternatives has been desirable.

Accordingly, it is a primary object of the present invention to provide apparatus that readily converts a 3-way switch socket to convenient use with 1-way light bulbs.

In the achievement of the foregoing object, it is another object of the invention to provide apparatus which adapts a 3-way socket switch to produce sequential "on"-"off" positions when the switch is operated.

Another very important object of the present invention is to provide an adapter which can be quickly and easily used with a conventional 3-way switch which eliminates the necessity for operating the switch through a plurality of unwanted switch positions before reaching a desired switch position when the switch is used with a 1-way light bulb.

A further object of the invention is to provide such an adapter which may be economically fabricated and yet which is durable and reliable.

A yet further object of the invention is to provide a modified form of the invention wherein relatively simple alteration of certain internal switch components provides for selective use of the switch with 3-way or 1-way light bulbs.

These and other important aims and objectives of the present invention will be further explained or will be apparent from the following description of the drawing, wherein.

Figure 5:
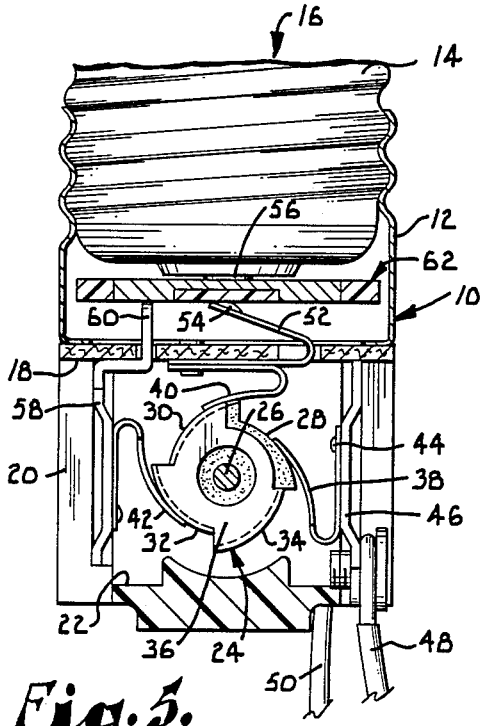
FIG. 5 is a detailed cross-sectional view through a socket switch showing the adaptor of FIGS. 1 and 2 interposed between the switch terminals and a 1-way light bulb in the switch socket.

Referring initially to FIG. 5 of the drawing, the reference numeral 10 broadly designates a 3-way light socket switch of a type commonly available and widely used in the construction of lamps. Switch 10 includes a metallic, conductive internally threaded tubular socket 12 adapted to threadably receive the metallic externally threaded collar 14 of a light bulb 16 as shown in FIG. 5. Socket 12 is rigidly secured by riveting or otherwise to a transversely extending, nonconductive wall 18 forming an integral part of a switch body 20 as shown.

Body 20 is provided with an internal cavity 22 containing a plurality of switch components as will be described. The primary moving switch component is a rotary switch element broadly designated by the reference numeral 24 and rigidly mounted on a shaft 26 for rotation therewith. Shaft 26 extends transversely through body 20 and projects outwardly therefrom in disposition to be rotated manually. Typically, a knob (not shown) is provided on shaft 26 externally of the switch body to facilitate manual rotation of the latter to operate the switch.

The outer periphery of element 24 is symmetrical with four substantially identical cam surfaces 28, 30, 32 and 34 spaced uniformly around the periphery of the element. Each of the surfaces 28–34 corresponds to a switch position for element 24 which is substantially 90° from the adjacent switch positions. Cam surfaces 30, 32 and 34 are of electrically conductive material and are mutually interconnected with one another. In the typical construction, element 24 may be constructed in the form of a disk of nonconductive material having the peripheral outline as heretofore described and as shown in the drawing. A sheath 36 of electrically conductive material is bent to cover surfaces 30, 32 and 34 to electrically connect all of these surfaces together as shown in the drawing. Sheath 36 does not cover surface 28, rendering the latter electrically nonconductive and insulated from the remaining cam surfaces of the switch element.

Cam surfaces 30–34 are electrically conductive switch contacts and cam surface 28 is an electrically nonconductive contact. These contacts cooperate with a plurality of contactors 38, 40 and 42 mounted on switch body 20 in cavity 22. The respective contactors 38–42 are of generally similar U-shaped, spring metal construction having one leg secured to the proximal surface of the switch body and the other leg projecting inwardly in cavity 22 in disposition to slidingly engage the respective cam surfaces 28–34 as element 24 is rotated in a counterclockwise direction as viewed in FIG. 5 of the drawing. It is readily apparent that the shoulders between adjacent cam surfaces of element 24 restrict rotation of the element to the counterclockwise direction. Further, it will be apparent that the construction is such that the contactors 38, 40 and 42 are always in sliding contact with which ever of the cam surfaces 28–34 may be adjacent the projecting leg of the respective contactor at any given time. Also, the contactors 38–42 are spaced in sequence substantially 90° apart around the axis of rotation of switch element 24 defined by shaft 26.

Contactor 38 is electrically connected as at rivet 44 with a connecting post 46 adapted to be electrically coupled with a source of electrical power such as electrical wire 48. The other wire 50 from the electrical source is electrically coupled with the metallic bulb receiving socket 12 by a suitable connection (not shown).

Contactor 40 is electrically connected to a spring terminal 52 having a contact 54 on its outer end as shown in FIG. 5. Contact 54 is disposed substantially on the longitudinal axis of socket 12 in disposition to engage the central filament lead-in 56 of a light bulb such as bulb 16. Manifestly, bulb 16 contains an internal circuit (not shown) extending from lead-in 56 through the bulb and to the metallic base collar 14 of the bulb so that energy which flows through the circuit produces an incandescent light.

Contactor 42 is electrically coupled with an elongated, rigid, longitudinally irregular post 58 having a portion 60 projecting through a hole in wall 18 and upwardly a short distance into socket 12 in radially spaced relationship from contact 54 of the central terminal 52 and also spaced inwardly from the metallic side wall of socket 12. Portion 60 is strategically disposed to electrically engage the lead-in ring (not shown) for the second filament circuit of 3-way light bulbs. Accordingly, when 3-way light bulbs are used with the 3-way socket switch 10, the terminals 52 and 60 are electrically engaged with the corresponding lead-ins for the bulb internal filament circuits. Each of the filament circuits is electricallY coupled with the metallic base or collar of the bulb.

In the conventional operation of switch 10 with a 3-way bulb, no electrical energy would flow to the bulb when the switch components are in the respective positions illustrated in FIG. 5 because contactor 38 is engaged on the insulated cam surface 28 and no current can flow from contactor 38 through the respective circuits. On the other hand, manual rotation of element 24 to the next switch position which is 90° counterclockwise from the position shown in FIG. 5 moves the components to the position shown in FIG. 6. In this position, current from contactor 38 flows through the conductive sheath interconnecting the three cam surfaces 34, 32 and 30. Accordingly, current flows through the switch element to contactor 42 and post 58 to the post terminal portion 60. Since the latter is engaged with the bulb lead-in for one filament circuit, the circuit is energized when the switch is in this position. It should be noted, however, that contactor 40 is engaged with the insulated cam surface 28 so no current flows to terminal 52 to energize the second bulb filament circuit. Typically, the wattage of the filament circuit which is energized with the components in the position shown in FIG. 6 would be relatively low to produce a relatively dim light from the bulb.

Figure 7:
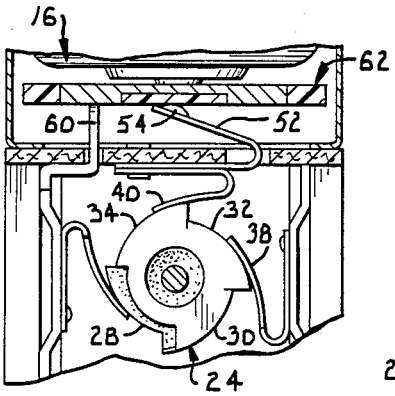
FIG. 7 is a view similar to FIG. 6 but showing the switch element in the next successive position from that shown in FIG. 6.

Rotation of element 24 to the position shown in FIG. 7 moves the insulated cam surface 28 into engagement with contactor 42, thereby terminating current flow to the first filament circuit of the bulb. On the other hand, current flows from contactor 38 engaged on surface 32 through the sheath and to contractor 40 engaged on surface 34. This energizes terminal 52 to energize the second filament circuit of the bulb emanating from the central lead-in of the bulb engaged on contact 54 of the switch. Typically, the second filament circuit is of a wattage to produce a relatively brighter light from the bulb than is produced by the first circuit when the latter is energized.

It will be readily understood from the foregoing that rotation of switch element 24 to the next succeeding switch position results in the interconnecting of all three contactors 38, 40 and 42 through the sheath 36 of the switch element. This, of course, provides electrical current through both bulb filaments smultaneously to produce a still brighter light from the bulb. Further, rotation of switch element 24 to the next switch position returns the components to the relative positions shown in FIG. 5 and terminates the flow of electric current to the bulb. Obviously, further rotation of the switch element from this off position repeats the cycle which has been described in detail above.

When, however, switch 10 is used with 1-way bulbs having a single filament circuit between the center of the bulb base and the external bulb collar, the switch positions provided for energizing pole portion 60 are not only not needed, but are a nuisance to the convenient operation of the switch. Note that when the components are in the second switch position illustrated in FIG. 6, no current can flow to a 1-way bulb because of the electric isolation of the central terminal 52 by insulated cam surface 28. Rotation of the switch element to the next successive position illustrated in FIG. 7 does energize a 1-way bulb. However, the next successive switch position does not turn the bulb off as would be desired when using a 1-way bulb. Rather, the central bulb energizing terminal 52 remains energized by virtue of the interconnection of cam surfaces 30 and 32.

Figure 1:
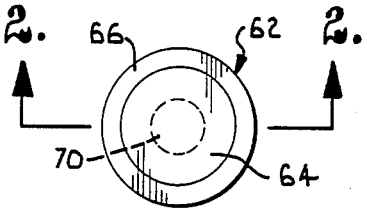
FIG. 1 is a top plan view of an adaptor embodying the principles of this invention, the nonconductive inlay of the adaptor being shown in phantom.
Figure 2:
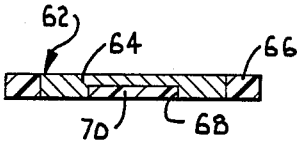
FIG. 2 is a cross-sectional view taken along line 2—2 of FIG. 1.
Figure 6:
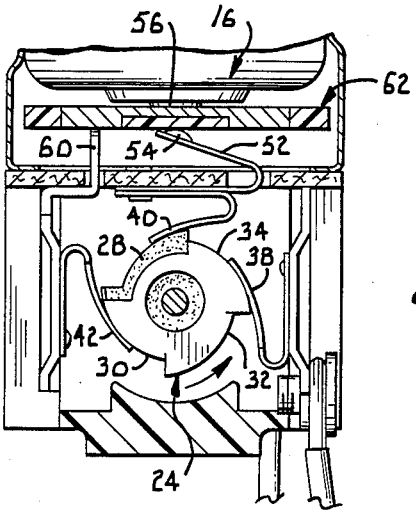
FIG. 6 is a fragmentary view similar to FIG. 5 but showing the switch element in the succeeding switch position.

A device to be used with conventional 3-way socket switches to eliminate the inconvenient operation when used with 1-way bulbs is broadly designated in the drawing by the reference numeral 62 and is shown in FIGS. 1 and 2 of the drawing as well as in its operative position in FIGS. 5 through 7. Device 62 comprises an adaptor preferably in the form of a rigid, relatively thin disc-shaped member comprised of two distinct portions. The central portion 64 is of electrically conductive material shaped as shown best in FIGS. 1 and 2 of the drawing. The outer circular periphery of conductive portion 64 is surrounded by an annular ring portion 66 of electrically nonconductive material and integrally secured to central portion 64 as shown. A circular recess 68 is provided in the center of portion 64 and extends inwardly from one flat surface of the disk. An insert 70 of electrically nonconductive material is complementally received in recess 68 and is secured in the latter.

FIGS. 5 through 7 of the drawing show adaptor 62 in its operative position extending transversely across socket 12 of switch 10 with insert 70 engaged against contact 54 of switch terminal 52. Further, pole portion 60 of the switch is engaged against the electrically conductive portion 64 of the adaptor. The central bulb lead-in 56 of a 1-way light bulb is in electrical contact with portion 64.

With adaptor 62 in this operative position, no current flows to the bulb when the components are in the relative position shown in FIG. 5 because of engagement of the power contactor 38 against the insulated cam surface 28. On the other hand, movement of the switch element to the position shown in FIG. 6 energizes the light bulb by the flow of current from contactor 38 through the element sheath and surface 30 to contactor 42. The current passes through pole 58 and conductive portion 64 of adaptor 62 to the filament lead-in 56 of the bulb.

Rotation of the switch element to its next switch position turns the bulb to an "off" condition. Contactor 42 engages the insulated cam surface 28 and contactor 40, which is in electrical contact with the power contactor 38 is, however, insulated from the bulb by the nonconductive adaptor insert 70.

The next successive switch position, however, reenergizes the bulb through electrical contact made from contactor 38 through the element sheath to contactor 42 which is in electrical connection through adaptor portion 64 with the bulb lead-in. Again, movement of the switch to its next successive position returns the bulb to an "off" condition by moving insulated cam surface 28 into contact with our contactor 38. It will be readily apparent that adaptor 62 which insulates the central switch contact 54 from the center bulb filament lead-in and which also electrically connects the lead-in with the intermediate switch terminal 60 insures that each successive switch position of the 3-way switch produces a different bulb condition (on or off) when the switch and adaptor are used with 1-way bulbs.

Figure 3:
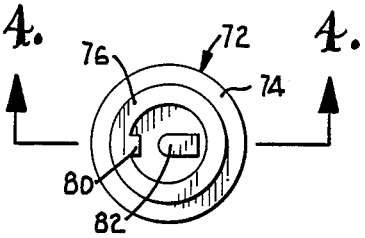
FIG. 3 is a view similar to FIG. 1 but illustrating a modified form of adaptor.
Figure 4:
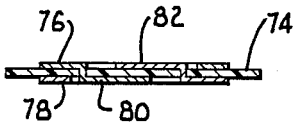
FIG. 4 is a cross-sectional view taken along line 4—4 of FIG. 3.

An alternate form of the invention is illustrated in FIGS. 3 and 4 of the drawing. In this form, the adaptor broadly designated by the reference numeral 72 is constructed so that it will be serviceable irrespective of which major face of the adaptor is facing toward the bulb. The adaptor 72 comprises a substantially flat, round disc 74 of electrically nonconductive material. A pair of preferably identical rings 76 and 78 or electrically conductive material are disposed on corresponding opposite major surfaces of disc 74 and are preferably secured to the latter by adhesive or the like. The respective rings 76 and 78 are of a size and are disposed in position to be engaged by the intermediate terminal such as terminal 60 of a 3-way switch when the adaptor is interposed in the switch socket in the manner generally similar to the position of adaptor 62 shown in FIGS. 5 through 7 of the drawing.

Ring 76 has an integral tang 80 projecting inwardly therefrom and extending transversely through a hole in disc 74 and across the opposite surface of the disc in disposition to be engaged the central lead-in of a light bulb when the corresponding surface of disc 74 is facing toward the bulb. Correspondingly, ring 78 has an integral tang 82 which may be identical with tang 80 and which extends through its corresponding hole through disc 74 and across the opposite surface of member 74 to also be in a position to be engaged by the central lead-in of the light bulb when that surface of the adaptor is facing the bulb. Member 74 extends outwardly beyond the rings 76 and 78 as shown in FIGS. 3 and 4. This insures that the electrically conductive rings and their corresponding tangs are insulated from the metallic switch socket. The ring 76 or 78 which is in position to engage the terminal 60 of the switch is placed by the ring and its corresponding tang into electrical contact with the central lead-in for the bulb. On the other hand, the other ring and its corresponding tang are electrically isolated from the bulb by the nonconductive nature of disc 74. It will be readily understood that adaptor 72 functions identically to that heretofore described with respect to adaptor 62. Moreover, it will be seen that this functioning will occur irrespective of the orientation of the major faces of the adaptor when the adaptor is interposed between the bulb and the switch terminals.

Figure 8:
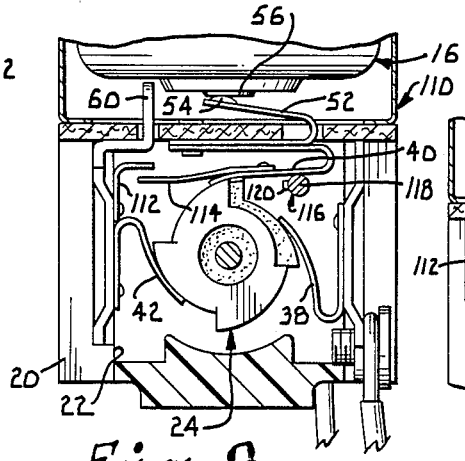
FIG. 8 is a view similar to FIGS. 5 through 7, but illustrating a modification of the switch to produce optional sequential "on"-"off" operation of a 1-way light bulb, the switch components being shown in position for normal operation with a 3-way bulb.
Figure 9:
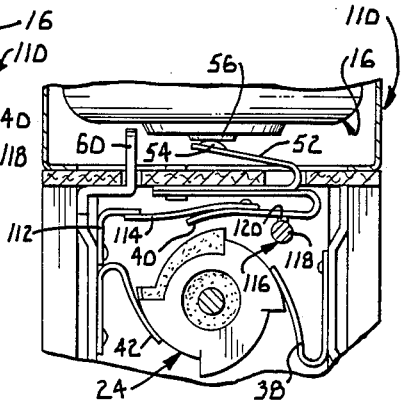
FIG. 9 is a view similar to FIG. 8 but showing the switch components in disposition for operation with a 1-way bulb.

FIGS. 8 and 9 of the drawing illustrate a modified construction for a 3-way switch socket to embody the principles of this invention without the necessity for use of a separate adaptor such as adaptor 62 and adaptor 72. The modified switch 110 is identical with switch 10 previously described with the exception of three modifications which will be explained in detail. Accordingly, the reference numerals used in describing switch 10 are also used for like parts in the depicting of switch 110, however, new reference numerals are used to describe the components comprising the modifications for the switch.

The first such modification includes an elongated, L-shaped, relatively rigid switch contact 112 mounted in cavity 22 in electrical contact with contactor 42. The second modification comprises an extension 114 of electrically conductive material secured to and carried by switch contactor 40. The outwardly projecting end of extension 114 is disposed to be engageable with the inwardly projecting leg of contact 112 to electrically interconnect terminal 52 and terminal 60.

The final modification for the switch comprises an actuator broadly designated by the reference numeral 116 including a shaft 118 rotatably carried by body 20 and extending transversely through cavity 22. Shaft 22 preferably projects outwardly through the body of switch 110 in disposition to be manually rotated and a knob (not shown) may be provided on the shaft for convenient rotation of the latter. A projection 120 integral with shaft 118 projects radially outwardly from the axis of rotation of the latter in disposition to engage contactor 40 to shift the latter out of engagement with switch element 24 when the shaft is rotated to move the projection to the position illustrated in FIG. 9 of the drawing. Conversely, projection 120 is manually rotatable to the position shown in FIG. 8 of the drawing wherein contactor 40 engages switch element 24 as has been heretofore described.

The relative positions of contact 112, extension 114 and actuator 116 are such that when the latter is in the position shown in FIG. 8, switch 110 performs in the manner of conventional 3-way switches. Extension 114 is spaced away from contact 112 so no electrical connection is made between contactor 40 and contactor 42 during such operation. Obviously, switch 110 is ideally suited for use with 3-way bulbs when the internal components are in this position.

On the other hand, when it is desired to use the switch with conventional 1-way bulbs, for example, the bulb 16, an operator need only manually rotate the actuator to the position shown in FIG. 9. Projection 120 of actuator 116 physically engages contactor 40 to swing the latter out of engagement with element 24 and to move extension 114 into electrical contact with switch contact 112. This prevents electrical current flow from element 24 to contactor 40 when the element is in that switch position which would normally produce only current flow from element 24 to contactor 40. This results in an "off" condition for the bulb when the element is in the corresponding switch position. On the other hand, when the element is in those switch positions which energize terminal 60, current flow is provided through contact 112 and extension 114 ultimately to the center lead-in 56 for the bulb. This results in an "on" condition for the bulb.

It will be readily recognized by those skilled in the art that the modified switch construction, when in the position shown in FIG. 9 produces alternate "on" and "off" conditions for a 1-way light bulb with actuator 116 in the position shown in FIG. 9. The modifications to the switch heretofore described can, of course, be carried out with relatively simple and inexpensive changes to the switch either during construction or as a retrofit modification.

Having thus described the invention, I claim:

1. For use with a 3-way lamp switch for 3-way bulbs having an electrically conductive collar, a first filament circuit extending from a lead-in disposed centrally of the bulb base to the collar, and a second filament circuit extending from a second lead-in electrically insulated from the first lead-in to the collar, apparatus for converting said switch for use with 1-way bulbs having an electrically conductive collar and a single filament circuit extending from a single lead-in disposed centrally of the bulb base to the collar, said switch including a socket adapted to receive a bulb therein, said socket having a base terminal engageable with the bulb collar and adapted to be coupled with a source of electricity, a first terminal disposed to electrically engage the central bulb lead-in, and a second terminal engageable with the second lead-in of said 3-way bulb, said switch including a 4-position rotary element rotatable in 90 degree increments in one direction, three electrically conductive and mutually interconnected contacts and an electrically nonconductive contact carried by the element for rotation therewith, said contacts being spaced at 90 degree intervals around the axis of rotation of the element to correspond with the four positions of the latter, said switch having a first contactor electrically connected with the socket first terminal, a second contactor electrically connected to the socket second terminal and a third contactor adapted to be coupled with said source of electricity, said first, second and third contactors being mounted adjacent said element for each contactor to physically engage a corresponding contact of the element when the latter is in each of its respective positions, the normal path for flow of electricity to the bulb central lead-in being from the element through the first contactor to the switch first terminal said converting apparatus comprising:

means for preventing a flow of electrical current between the switch element and the central lead-in of a bulb directly through said normal path when the latter is in the socket irrespective of the position of rotation of the switch element; and means for electrically connecting said second contactor of the switch with the central lead-in of the bulb through an alternate electrical current path, whereby said bulb filament circuit is alternately energized and interrupted by the switch as the switch element is rotated successively through its respective positions.

2. Apparatus as set forth in claim 1, wherein said means for preventing electrical current flow comprises a barrier of electrically insulative material interposed between the switch first terminal and said bulb and wherein said electrically connecting means includes an electrical conductor interposed in the switch socket in disposition to engage the second switch terminal and the central bulb lead-in.

3. Apparatus as set forth in claim 2, wherein said apparatus includes a member adapted to be disposed in the socket between the switch terminals and said bulb, the current flow preventing means and said electrical connecting means being carried by said member.

4. Apparatus as set forth in claim 1, wherein said current flow preventing means includes means engageable with the switch first contactor for physically moving the latter out of electrical contact with the switch element, and wherein said electrically connecting means includes an electrical conductor operably coupled with the switch first contactor and with the switch second contactor when the latter is out of electrical contact with the switch element, whereby to electrically connect said second contactor to the central bulb engageable terminal of the switch.

5. Apparatus as set forth in claim 4, wherein said engageable means includes a cam means mounted in the switch in disposition to engage said first contactor, said cam means being manually operable between a standby position permitting the first contactor to engage the switch element to an alternate position moving the first contactor away from engagement with the element and into electrical connection with said second switch contactor.

6. An insert for converting a 3-way bulb lamp socket switch for use with 1-way bulbs, said switch including a central terminal disposed in the socket for engaging the central lead-in in the base for a light bulb, and a second terminal projecting upwardly in the socket in disposition for engaging the lead-in ring for the second filament circuit of a 3-way light bulb, said insert comprising:

a rigid member adapted to be installed in the socket in disposition extending substantially transversely across the socket;

electrically insulative means carried by the member electrically insulating the outer perimeter of the member from the socket side wall;

electrically insulative means carried by the member and engageable with the central terminal of the socket for electrically insulating the latter from the central lead-in of a light bulb when the latter is installed in the socket;

electrically conductive means carried by the member and engageable with said second terminal of the socket and adapted to be engaged with the central lead-in of a light bulb in the socket, whereby operation of the switch alternately energizes and deenergizes the central lead-in of the light bulb rendering the socket available for use with 1-way light bulbs.

7. An insert as set forth in claim 6, wherein said member is a disc.

8. An insert as set forth in claim 7, wherein said disc is relatively thin and has a circular periphery.

9. An insert as set forth in claim 8, wherein said insert has a pair of opposed, substantially flat major faces, one of said faces being adapted to be contacted by the terminals of the switch when the insert is in the switch socket, the other face of the disc being disposed to be engaged the central lead-in of a bulb when the latter is installed in the socket.

10. An insert as set forth in claim 9, wherein said disc comprises a disc shaped central portion of electrically conductive material having a pair of opposed surfaces coplanar with the corresponding disc faces, there being a recess in one surface of the portion centrally of the latter;

an inlay of electrically insulative material secured in the recess, the outer surface the inlay being co-planar with the face of the disc engagable by the switch terminals whereby the central switch terminal engages said inlay; and an annular peripheral rim of electrically insulative material secured to the periphery of the portion and projecting radially outwardly therefrom in disposition to prevent electrical contact between the portion and the side wall of the socket when the insert is in said socket.

* * * * *